US009521881B2

(12) United States Patent
Bachtold

(10) Patent No.: US 9,521,881 B2
(45) Date of Patent: Dec. 20, 2016

(54) FLEXIBLE ACCESSORY HOLDER

(71) Applicant: Joran Bachtold, Chatham, IL (US)

(72) Inventor: Joran Bachtold, Chatham, IL (US)

( * ) Notice: Subject to any disclaimer, the term of this patent is extended or adjusted under 35 U.S.C. 154(b) by 0 days.

(21) Appl. No.: 14/184,178

(22) Filed: Feb. 19, 2014

(65) Prior Publication Data

US 2014/0304898 A1 Oct. 16, 2014

Related U.S. Application Data

(60) Provisional application No. 61/811,954, filed on Apr. 15, 2013.

(51) Int. Cl.
*A41F 17/00* (2006.01)
*A44B 11/04* (2006.01)

(52) U.S. Cl.
CPC ..... *A44B 11/04* (2013.01)

(58) Field of Classification Search
CPC ..... A41F 17/00; A44B 11/04
USPC ..... 24/198, 3.13, 3.1, 3.4, 66.9
See application file for complete search history.

(56) References Cited

U.S. PATENT DOCUMENTS 362,203 A * 5/1887 Carter et al. ..... 24/198
459,362 A * 9/1891 Guilbert ..... 24/198
783,396 A * 2/1905 Bass ..... 24/198
858,989 A * 7/1907 Keiser ..... D06F 55/00 24/343
869,030 A * 10/1907 Stenzy ..... 24/198
1,147,955 A * 7/1915 Langhammer ..... 24/198
2,095,340 A * 10/1937 Meyer ..... 24/198
2,099,199 A * 11/1937 Devendor et al. ..... 24/198
2,123,773 A * 7/1938 Eppink ..... 24/163 R
D127,740 S * 6/1941 Montmartin ..... D11/202
2,278,153 A * 3/1942 Shaulson ..... 24/200
2,569,933 A * 10/1951 Johnson ..... A44B 11/04 24/197
2,941,213 A * 6/1960 Eliasberg ..... 2/154
3,218,686 A * 11/1965 Rubenstein ..... 24/198
3,748,661 A 7/1973 Smith
3,869,763 A * 3/1975 Senk et al. ..... 24/198
4,038,724 A 8/1977 Parizek
4,667,346 A * 5/1987 Strollo ..... 2/152.1
4,911,991 A * 3/1990 Van Ooij ..... 428/658
D316,530 S * 4/1991 Clifton ..... D11/202
5,023,978 A 6/1991 Thompson et al.
(Continued)

*Primary Examiner* — Robert J Sandy
*Assistant Examiner* — Rowland Do
(74) *Attorney, Agent, or Firm* — Global Intellectual Property Agency, LLC; Daniel Boudwin

(57) ABSTRACT

An accessory holder for retaining accessories around the body of a user is provided. The holder includes a circular or oval-like perimeter with a central support that divides the device into two half-moon openings. The frame of the accessory holder is made of a flexible wire that is capable of being bent or folded into a variety of configurations, whereby the form is retained throughout the day. An elastomeric or rubber coating may be applied to the frame to add to the aesthetic appeal of the device. An accessory fabric, such as a scarf, may be inserted into the half-moon shaped openings of the holder. The ends of the scarf may be looped, weaved, or otherwise secured through the accessory holder. A user may secure the scarf around the waist, neck, or other suitable part of the body with the accessory holder maintaining the desired orientation of the accessory.

9 Claims, 4 Drawing Sheets

(56) References Cited

U.S. PATENT DOCUMENTS

Figure 1:
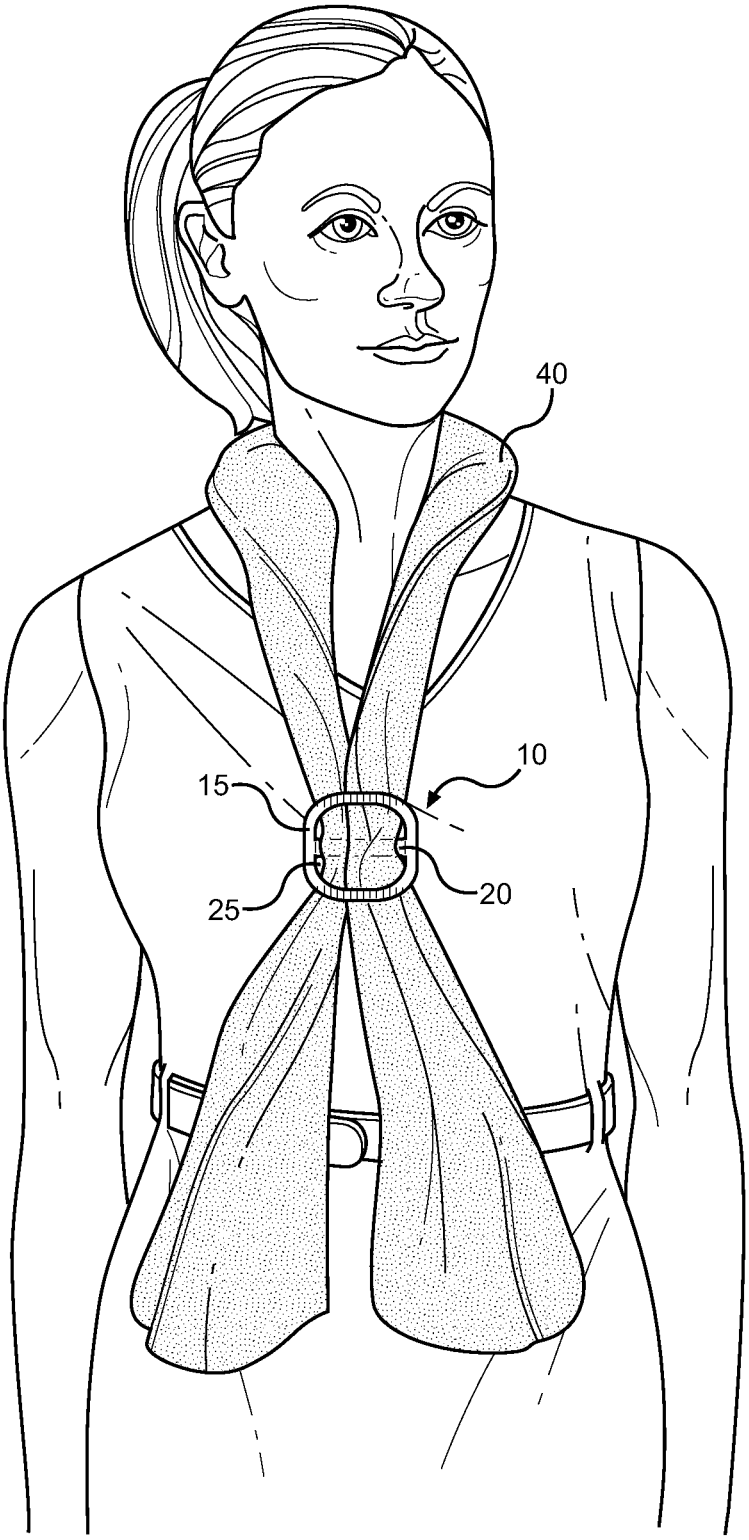

| | | | | | |
|---|---|---|---|---|---|
| 5,233,704 | A * | 8/1993 | Booher | 2/207 | |
| 5,353,481 | A | 10/1994 | Farris, Jr. | | |
| D357,646 | S * | 4/1995 | Movizzo | D11/202 | |
| 5,511,289 | A * | 4/1996 | Melia | A44B 6/00 | 24/459 |
| 5,655,224 | A * | 8/1997 | Sears | 2/171 | |
| 5,655,272 | A * | 8/1997 | Young | 24/482 | |
| 5,765,232 | A * | 6/1998 | Pryor | 2/217 | |
| 5,990,402 | A * | 11/1999 | Epstein | G10D 13/06 | 24/115 H |
| 6,056,625 | A * | 5/2000 | Fildan | 450/86 | |
| 6,059,634 | A * | 5/2000 | Fildan | 450/86 | |
| 6,243,925 | B1 * | 6/2001 | Aszody | A47G 25/48 | 24/30.5 S |
| 6,263,512 | B1 * | 7/2001 | LeDonne | 2/171 | |
| 6,435,940 | B1 * | 8/2002 | Fildan et al. | 450/86 | |
| 6,916,260 | B1 * | 7/2005 | Poteet | 473/551 | |
| 7,234,995 | B2 * | 6/2007 | Fildan et al. | 450/86 | |
| 7,299,527 | B1 | 11/2007 | Gyure | | |
| 7,331,353 | B2 * | 2/2008 | Harvie | 132/273 | |
| 7,601,048 | B2 * | 10/2009 | Groner | A41C 3/0028 | 2/336 |
| 8,347,416 | B1 * | 1/2013 | Query | 2/265 | |
| 8,782,816 | B2 * | 7/2014 | Bielobocky | 2/207 | |
| 9,247,777 | B2 * | 2/2016 | Sullivan | A41F 19/00 | |
| 2006/0150301 | A1 * | 7/2006 | Mehren | A41D 1/06 | 2/232 |
| 2006/0252347 | A1 * | 11/2006 | Fildan | A41F 15/002 | 450/86 |
| 2010/0043125 | A1 * | 2/2010 | Maclean | A44B 11/04 | 2/336 |
| 2013/0276212 | A1 * | 10/2013 | Lee-Holowka | A45F 5/00 | 2/271 |

* cited by examiner

FLEXIBLE ACCESSORY HOLDER

CROSS REFERENCE TO RELATED APPLICATION

This application claims the benefit of U.S. Provisional Application No. 61/811,954 filed on Apr. 15, 2013. The above identified patent application is herein incorporated by reference in its entirety to provide continuity of disclosure.

BACKGROUND OF THE INVENTION

Field of the Invention

The present invention relates to a scarf buckle. More specifically the invention relates to a flexible buckle-like device that is configured for securing accessories around a user.

Buckles are generally used to secure a strap or similar garment member around the body of a user. Typically these devices include an open clasp configured to accept the garment therethrough and secure the same therein. The buckle is designed to maintain tension of the strap around the body, thereby assisting in supporting a garment around a user's body.

Although the traditional buckle design is useful for its own purposes, there are those who desire buckles that provide attachment for garment accessory items and one that is useful for various stylistic purposes. Traditional buckle designs are generally deployed on belts and the like, and are incapable of supporting garment accessories by themselves.

A scarf is one common device that is worn around the waist for decorative purposes. Generally a scarf can be supported using a sleeve element or a buckle type attachment, which secures the ends of the scarf around the body of a user. These devices, however, lack the ability to conform to the scarf or to the particular garment accessory being worn, wherein the accessory item will be successfully retained together despite the accessory thickness or material type.

There are several devices of the prior art that are configured to provide a successful means of supporting a piece of fabric or accessory item such as a scarf. These devices provide a way of securing a scarf around a user without piercing the fabric. These include use of a clip around the fabric, a rigid sleeve element that slides over the accessory, or the use of a buckle type or strap type securement element. However, these devices do not conform well to the accessory items being supported an tend to loosen their grip thereon over time.

The present invention provides an accessory holder that is flexible and can be contorted into a shape that prevents an accessory from being withdrawn from the device without the user's intention to do so. The device comprises an oval or circular frame of wire material having a central support extending through the center thereof. The frame of the device is formed from a flexible wire that is capable of holding its form when bent, thereby enabling the device to be held in a variety of configurations. The frame may be coated with an elastomeric or rubberized material that is adapted to be compliant and not resist the deformed shape of the flexible wire interior when bent. The coating may be painted or decorated with designs, thereby increasing the aesthetics of the device. A user bends the device into a desired shape as a garment accessory or the user's pony tail is looped therethrough, wherein the deformed shape of the frame allows the accessory item or the user's ponytail to be securely held therein.

Description of the Prior Art

Devices have been disclosed in the prior art that relate to decorative buckles. These include devices that have been patented and published in patent application publications. These devices generally relate to buckles that clip onto a fabric, or comprise slots for weaving the fabric therein to secure the fabric to the buckle. The following is a list of devices deemed most relevant to the present disclosure, which are herein described for the purposes of highlighting and differentiating the unique aspects of the present invention, and further highlighting the drawbacks existing in the prior art.

One such device, U.S. Pat. No. 5,023,978 to Thompson provides a scarf clip adapter for a brooch or earring. The device comprises a front-planar member that is fastened by a hinge to a rear member. The rear member has a large opening to accommodate the ends of a scarf. A scarf is inserted through the rear member and clipped therein for wearing in a traditional manner. The clipping of the scarf, however, has the potential to damage the structural integrity of the scarf.

Another device, U.S. Pat. No. 7,299,527 to Gyure provides a strap retainer device that is configured for attaching a first object to a second object. A first end is shaped for the reception of the first object, and the second end includes a tortuous passageway therethrough for the reception of the second object. The second pathway is configured to prevent the accidental removal of the second device. The device, however, requires a user to bend or fold the strap-like object in order to secure the object within the tortuous passageway, whereas the present invention is configured to flex to accommodate the attachable fabric.

U.S. Pat. No. 3,218,686 to Rubenstein describes a shoulder strap and scarf clasp. The device comprises an S-shaped holder with two spaced openings, through which the scraps or scarf may be threaded. Although the prior art device is similar in nature and relevant to the present invention, it differs in that it fails to provide a flexible device that is configured to provide a plurality of orientations for supporting a scarf thereon.

U.S. Pat. No. 5,353,481 to Farris, Jr. provides a device for displaying and holding a scarf or handkerchief in a pocket. The device comprises a frame member with a slot for the reception of the scarf. A clip is attached onto the frame for holding the scarf in an upright position within the pocket. The clip of the device, however, is capable of misshaping the scarf, whereas the present invention lacks a clip that may alter the structural integrity of the fabric.

Yet another prior art device, U.S. Pat. No. 3,748,661 to Smith provides an adjustable scarf. The end of a scarf is configured to be fed through a ring having a diameter that offers sufficient friction to remain in place. The end of the scarf may be pulled through the ring to alter the length of the scarf. While the device of Smith is similar in nature and relevant to the present invention, it fails to provide a flexible device for holding the scarf in a variety of orientations.

Finally, U.S. Pat. No. 4,038,724 to Parizek provides a friction grip pendant for retaining a scarf around a wearer's neck. The device includes a base member with an upper half-ring member and a pair of spaced apart half-ring members. A user places the ends of the scarf through the first member and thereafter separates ends into the spaced apart ring members. The ends of the scarf are pulled in order to tighten the scarf to the desired position on the neck of a user. The device, however, lacks a flexible member that may be bent and folded into different orientations for the support of a scarf therein.

The present invention, however, provides a flexible accessory holder. The device has an oval or circular frame with a central support dividing the frame in half, thereby providing a frame having a pair of identical half-moon shaped sides. The frame is formed from a flexible wire that is configured to hold a bent formation until acted on by the user, which enables the device to be maintained in a variety of orientations. An elastomeric or rubber coating may be applied to the exterior of the wire frame. The coating may comprise a plurality of colors or designs to suit the aesthetic tastes of the user. In use, a user may bend the device into a desired shape, thereafter a piece of fabric may be looped through the device in a manner that enables placement on to the body of the user. The device enables a fabric, such as a scarf, to be secured around the neck or waist of a user. The device may also be used for securing other accessories, such as belts, waist ties, bows, waistbands, shoelaces, and shirts. Alternatively, the device may be bent into an accessory for presenting hair in a variety of styles.

The present invention substantially diverges in design elements from the prior art and consequently it is clear that there is a need in the art for an improvement to existing scarf holding devices. In this regard the instant invention substantially fulfills these needs.

SUMMARY OF THE INVENTION

In view of the foregoing disadvantages inherent in the known types of accessory holders now present in the prior art, the present invention provides a new device wherein the same can be utilized for providing convenience for the user when maintaining a scarf around the body is desired.

It is therefore an object of the present invention to provide a new and improved accessory holding device that has all of the advantages of the prior art and none of the disadvantages.

It is another object of the present invention to provide an accessory holding device that is configured for holding a scarf on a user.

Another object of the present invention is to provide a flexible accessory holder that is configured to retain its bent shape until acted on by the user.

Yet another object of the present invention is to provide a variety of different sized accessory holders that are configured for holding accessories on a user.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 displays a view of the present invention in use, whereby the accessory holder positions a scarf around the neck of a user.

Figure 2:
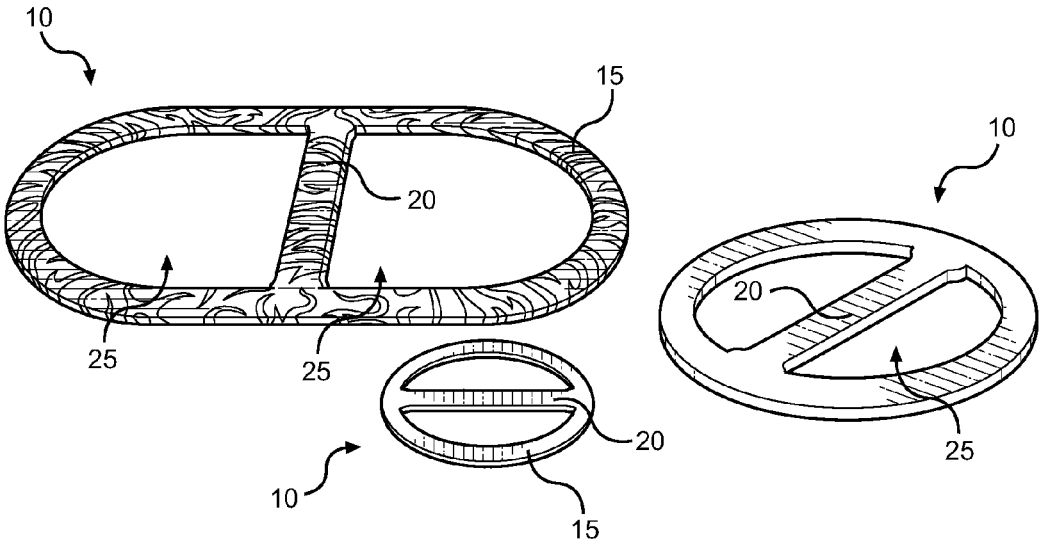

FIG. 2 displays a plurality of differently sized devices of the present invention.

Figure 3:
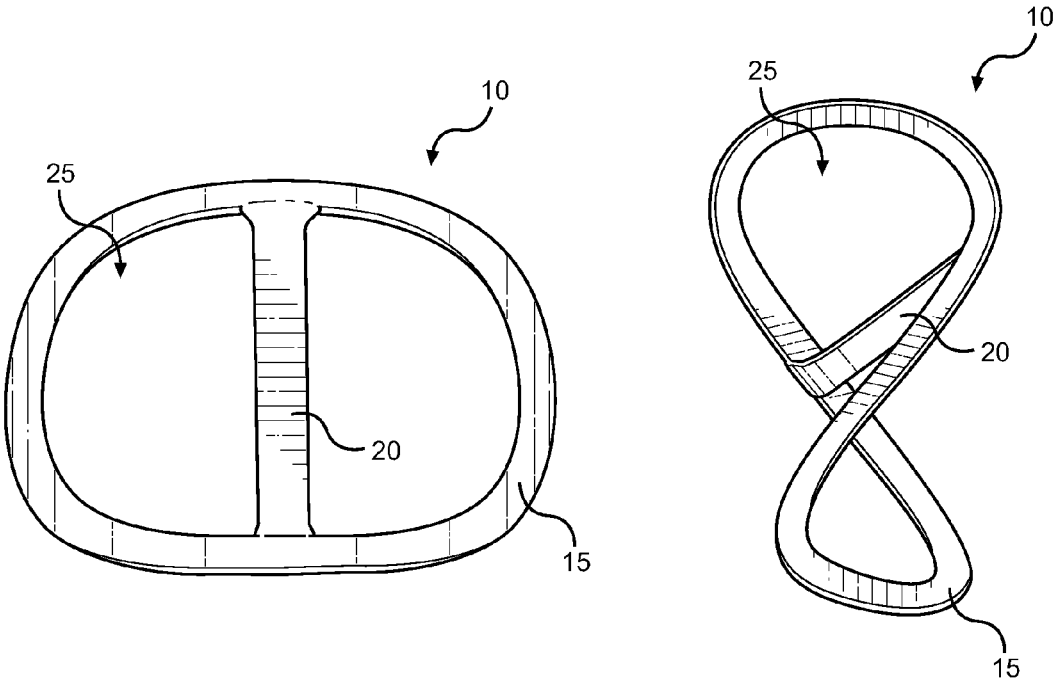

FIG. 3 displays the flexibility of the present invention.

Figure 4:
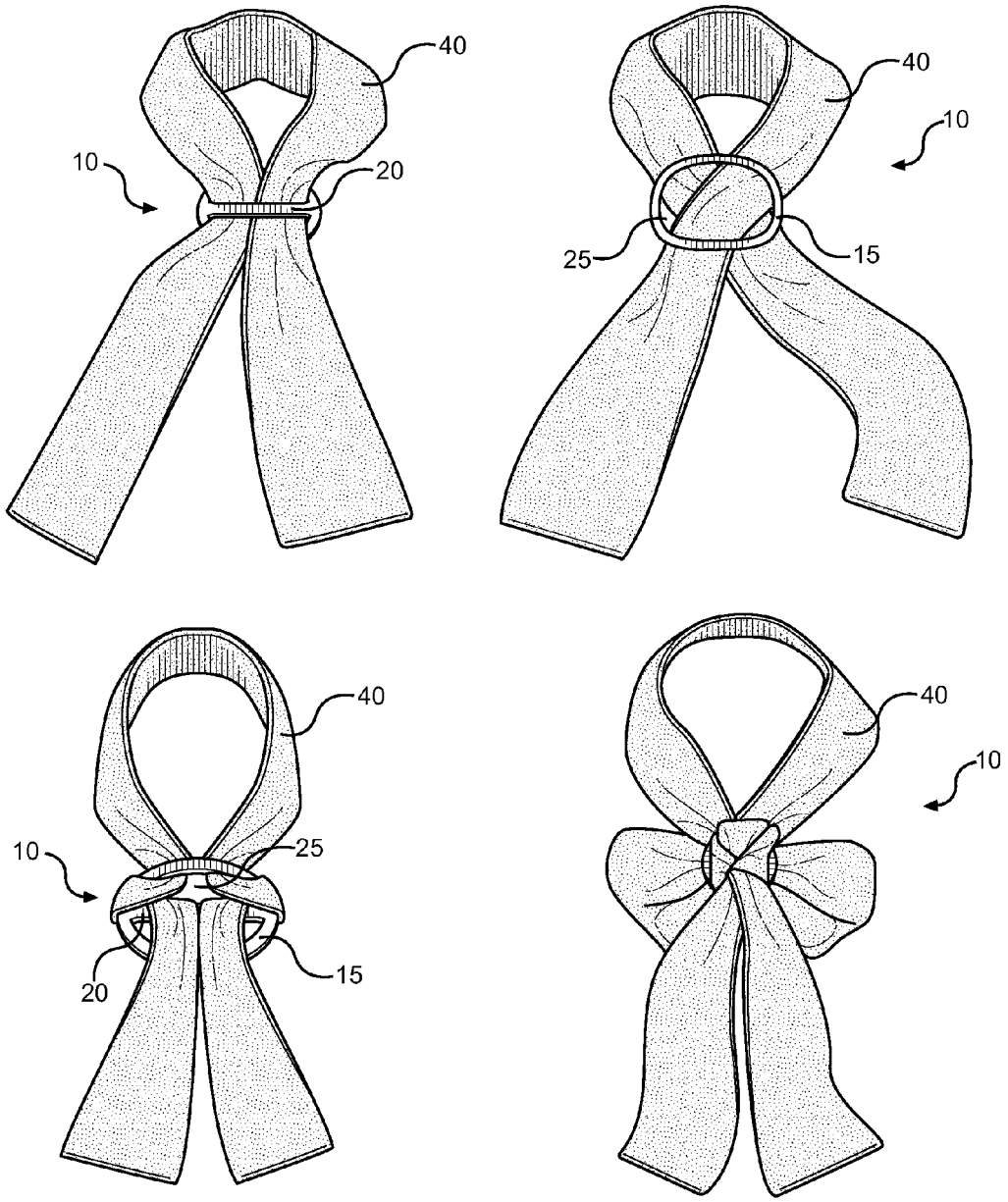

FIG. 4 displays the present invention in use, whereby a scarf is inserted into the frame of the device.

Figure 5:
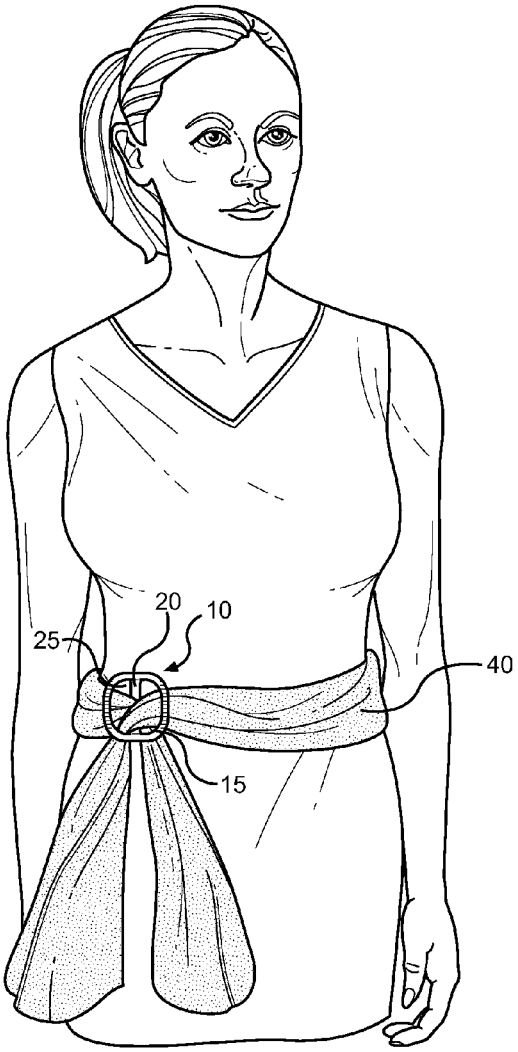

FIG. 5 displays a view of the present invention in use, whereby a scarf is secured around the waist of a user.

Figure 6:
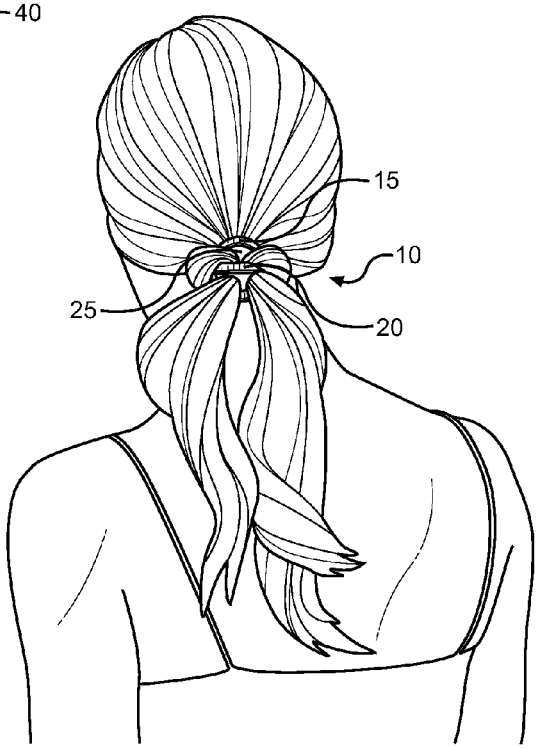

FIG. 6 displays a view of the present invention in use, whereby the device is utilized to decoratively arrange a user's hair.

DETAILED DESCRIPTION OF THE INVENTION

Reference is made herein to the attached drawings. Like reference numerals are used throughout the drawings to depict like or similar elements of the accessory holder. For the purposes of presenting a brief and clear description of the present invention, the preferred embodiment will be discussed as used for securing a scarf around the neck or waist of a user. The figures are intended for representative purposes only and should not be considered to be limiting in any respect.

Referring now to FIG. 1, there is shown a view of the present invention in use, whereby the accessory holder positions a scarf around the neck of a user. The accessory holder 10 comprises a circular frame 15 with a support 20 that extends through the center of the frame 15, thereby forming two half-moon shaped open halves 25. The holder 10 is configured to support an elongated accessory 40 within the half-moon shaped openings 25 of the frame 15. The accessory 40 may be a scarf, belt, bows, shoelaces, shirt, or a user's hair. The opposing ends of a scarf or similar shaped accessory 40 may be inserted through the half-moon shaped halves 25. The scarf ends may be wrapped or looped through and around the holder 10, thereby providing a decorative arrangement.

Referring now to FIG. 2, there is shown how the holders 10 may comprise a variety of designs, sizes, and shapes, whereby the shapes include that of an oval and circle. The frame 15 of the holder 10 may comprise a variety of designs, whereby the designs may be placed on a rubber coating of the frame 15. These designs may include any of variety of colors, patterns, shapes, and images. The designs may be utilized to match the accessory 40 or the clothing of the user.

Referring now to FIG. 3, there is shown a view of the holder 10 of the present invention, whereby the holder 10 is twisted. The frame 15 of the holder is made of a wire. The wire is flexible and is configured to retain its bent formation until the orientation is altered by a user. The variety of bent orientations facilitates the ability of the holder 10 to support an accessory in a desired presentation. The holder 10 may be twisted and bent over to provide a circular holder with an open interior, whereby the central support 20 is positioned on the exterior of the frame 15. The bending of the frame 15 provides a smaller interior, thus enabling support of smaller accessories, such as shoelaces, and thin belts. Moreover, an open interior provides for differing accessory tying patterns.

Referring now to FIG. 4, there are shown varying designs and patterns for wrapping an accessory 40 around the holder 10. For example, a fabric scarf may be woven between the frame 15 and central support 20 similar to that as a user would a belt buckle. Alternatively, the ends of a scarf may be looped around the sides of the perimeter, or the user may form a figure eight around the perimeter 15 and central support 20 of the holder 10. The alternative weaving patterns are capable of providing differing aesthetic looks from a traditional weave pattern.

Referring now to FIGS. 5 and 6 there are shown views of the present invention secured to a user. FIG. 5 displays a view of the accessory holder 10, whereby the holder 10 is configured to hold and support a scarf 40 around the waist of a user. Ends of the scarf 40 may be looped, wrapped, or weaved around and through the frame 15 of the holder 10, thereby providing differing aesthetic looks. The ends of the accessory scarf may pulled through the halves 25 of the holder 10 until a desired tension around the waist is achieved, thereby eliminating the need to insert the accessory 40 through belt loops on a pair of pants. A user may further secure the accessory 40 within the moon-shaped halves 25 by bending the holder 10 against the accessory scarf 40, thereby locking the scarf 40 within the holder 10.

FIG. 6 displays a view of the holder 10 of the present invention in use, whereby the holder 10 is secured around the hair of a user. The user's hair may be woven through the holder 10 in order to create an aesthetically pleasing hair design. Alternatively, the holder 10 may be twisted and folded in order to create a ring-like perimeter. A user's hair may be inserted through the center of the ring, thereby providing a variety of ponytail-like orientations for the user's hair.

The present invention provides a flexible accessory holder 10 that has a perimeter frame 15 in the form of an oval or circle. The perimeter is divided in half by a support 20 that forms two identical half-moon shaped sides 25. A flexible wire forms the frame 15, whereby the wire is configured to hold its form until acted on by a user. The wire frame enables a user to fold, bend, or twist the device into a variety of configurations to accommodate different aesthetic configurations. A rubber coating may be applied to the exterior of the wire frame. The coating may comprise a plurality of colors or designs to suit the aesthetic tastes of the user and to match the accessory the device is holding.

In use, a user may bend the device into a desired shape. A user may then place the ends of an accessory 40, such as a scarf, though the half-moon shaped sides of the accessory holder 10. The accessory may be looped, weaved, and braided through the half-moon shaped openings of the accessory holder, thereby enabling the accessory to be supported on the body of a user. The accessory may be a scarf, belt, waist tie, bow, waistband, shoelace, shirt, or other suitable accessory that may be looped through the accessory holder. The accessory holder 10 provides a decorative way to hold an accessory on the body of the user, for example around the neck or waist. A user is capable of tightening the accessory to a desired tension around the body by either pulling on the ends of the accessory or by adjusting the length of the ends before looping the ends through the holder. The accessory 40 may be secured within the half-moon shaped halves 25 of the holder by bending the frame 15 of the holder 10 against the accessory 10. The holder provides an advantage over traditional holders by enabling the alteration of the device to suit the user's needs.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An accessory holder is provided that is configured for supporting items therethrough and around the body of a user, comprising:

an open frame having an outer perimeter;

wherein said outer perimeter resembles an oval;

a support that extends across the open interior of said open frame, whereby said support divides said open frame into a first opening and a second opening;

said open frame and support being composed of a flexible wire;

wherein said flexible wire is configured to bend in a plurality of different configurations along a longitudinal axis and a latitudinal axis of said support and retain each of said plurality of different configurations.

2. The accessory holder of claim 1, wherein said first opening and said second opening are configured for the reception of the ends of a garment accessory.

3. The accessory holder of claim 1, wherein said first opening and said second opening are configured for the reception of the end of a user's hair for holding the same.

4. The accessory holder of claim 1, wherein said perimeter is rounded.

5. The accessory holder of claim 1, wherein said first opening and said second opening are identical halfmoon shaped.

6. The accessory holder of claim 1, wherein said open frame further comprises an outer coating of rubberized material.

7. The accessory holder of claim 1, wherein said open frame further comprises an outer coating of an elastomeric material.

8. The accessory holder of claim 1, wherein said open frame and said support are configured to twist such that a first end of said support attached to said outer perimeter is rotated as a second end of said support attached to said outer perimeter remains stationary.

9. The accessory holder of claim 1, wherein said open frame and said support are integral to one another.

* * * * *